US008905857B1

(12) United States Patent
Eckhart

(10) Patent No.: US 8,905,857 B1
(45) **Date of Patent: *Dec. 9, 2014**

(54) GOLF PUTTER WITH ADJUSTABLE HEAD

(71) Applicant: Lewis V. Eckhart, Tallahassee, FL (US)

(72) Inventor: Lewis V. Eckhart, Tallahassee, FL (US)

( * ) Notice: Subject to any disclaimer, the term of this patent is extended or adjusted under 35 U.S.C. 154(b) by 41 days.

This patent is subject to a terminal disclaimer.

(21) Appl. No.: 13/833,001

(22) Filed: Mar. 15, 2013

Related U.S. Application Data

(63) Continuation-in-part of application No. 13/329,627, filed on Dec. 19, 2011, now Pat. No. 8,579,716.

(51) Int. Cl.
*A63B 69/36* (2006.01)
*A63B 53/04* (2006.01)
*A63B 53/02* (2006.01)

(52) U.S. Cl.
CPC ..... *A63B 53/0487* (2013.01)
USPC ..... 473/244; 473/251; 473/252; 473/334; 473/340; 473/307

(58) Field of Classification Search
USPC ..... 473/219, 231, 244–248, 251–256, 340, 473/341, 305–315
See application file for complete search history.

(56) References Cited

U.S. PATENT DOCUMENTS

| | | | | |
|---|---|---|---|---|
| D246,329 | S | 11/1977 | Little | |
| 4,390,184 | A | 6/1983 | Rudell | |
| 4,629,193 | A * | 12/1986 | Pierman | 473/254 |
| 4,828,266 | A | 5/1989 | Tunstall | |
| 4,988,107 | A | 1/1991 | Sasse | |
| D325,949 | S | 5/1992 | Harris, Jr. | |
| 5,167,414 | A | 12/1992 | Montgomery | |
| 5,390,919 | A | 2/1995 | Stubs et al. | |
| 5,533,728 | A | 7/1996 | Pehoski et al. | |
| 5,564,990 | A | 10/1996 | Weeks | |
| 5,571,053 | A | 11/1996 | Lane | |
| D404,450 | S | 1/1999 | Weeks | |
| D405,491 | S | 2/1999 | Bizovi | |
| 5,947,837 | A | 9/1999 | Perry | |
| D434,094 | S | 11/2000 | Miyashita | |
| 6,176,791 | B1 | 1/2001 | Wright | |
| 6,817,953 | B2 | 11/2004 | Farmer | |
| D518,126 | S | 3/2006 | Sloboda | |
| 7,018,304 | B2 | 3/2006 | Bradford | |
| 7,070,515 | B1 | 7/2006 | Liu | |
| 7,326,121 | B2 | 2/2008 | Roake | |
| 7,351,162 | B2 | 4/2008 | Soracco et al. | |
| 7,806,778 | B2 | 10/2010 | Elmer | |
| 7,976,400 | B1 | 7/2011 | Pottorff | |
| 8,579,716 | B1 * | 11/2013 | Eckhart | 473/244 |
| 2008/0146370 | A1 | 6/2008 | Beach et al. | |
| 2009/0017933 | A1 | 1/2009 | Stites et al. | |
| 2009/0286612 | A1 | 11/2009 | Pouliot et al. | |

* cited by examiner

*Primary Examiner* — Sebastiano Passaniti
(74) *Attorney, Agent, or Firm* — Dowell & Dowell, PC

(57) ABSTRACT

A putter for use in a game of golf including a handle from which exends a shaft having a lower extension portion connected to a hosel mounted on a putter head having a front putting face, upper and lower surfaces and opposite side portions and wherein a central alignment groove extends along a central longitudinal axis of the head toward the putting face and wherein pairs of alignment members extend parallel on opposite sides of the central alignment groove and perpendicular to the putting face, and wherein at least one projection from the hosel is spaced above one of the pairs of alignment members and includes an alignment band for aligning with the one of pair of alignment members when the putter is addressed relative to a ball.

18 Claims, 3 Drawing Sheets

GOLF PUTTER WITH ADJUSTABLE HEAD

CROSS REFERENCE TO RELATED APPLICATIONS

This application is a Continuation-in-Part Application of application Ser. No. 13/329,627, filed Dec. 19, 2011, entitled GOLF PUTTER WITH ADJUSTABLE HEAD, in the name the present inventor. This application claims the benefit of the prior application and incorporates the teachings of the prior application in their entirity herein by reference.

BACKGROUND OF THE INVENTION

1. Field of the Invention

The present invention relates to a putter for use in the game of golf and more particularly to a putter of the "mallet" type wherein a hosel of the putter is adjustably mounted to a putter head so that the putter may be used by either left or right handed players. The hosel is mounted along a central axis of the putter head so as to be adjacent to the putter face and aligned with a "sweet spot" of the putter face. The hosel and portions of the lower end of the club handle shaft are used in cooperation with at least one pair of spaced alignment slots extending perpendicular to a plane of the putter face and on opposite sides of the hosel and a second pair of alignment slots provided adjacent the putter face and parallel to the face to insure that a golfer's position, during a putt, is such as to assure that a ball is centered on the "sweet spot" and the face of the club is aligned perpendicularly with an intended line of movement of the ball during the putt. In addition, weights may be added to the putter head in order to adjust a swingweight of the putter to a players preference.

2. Brief Description of the Related Art

The game of golf is enjoyed by people worldwide and there have been numberous innovations made to improve the clubs and the balls associated with the sport. Many of the innovations have been made to improve putters that are used to direct a ball when on a putting green of a golf course. Examples of innovations in golf putters are disclosed in U.S. Pat. No. 7,351,162 to Soracco et al, U.S. Pat. No. 7,326,121 to Roake, U.S. Pat. No. 7,018,304 to Bradford, U.S. Pat. No. 7,070,515 to Liu, U.S. Pat. No. 6,817,953 to Farmer, U.S. Pat. No. 5,947,837 to Perry, U.S. Pat. No. 5,571,053 to Lane, U.S. Pat. No. 5,564,990 to Weeks, and U.S. Pat. No. 5,533,728 to Pehoski et al. Additional innovations are shown in United States Published Applications 2009/0286612 to Pouliot et al, 2009/0017933 to Stites et al and 2008/0146370 to Beach et al. There have also been innovations with respect to the design characteristics of putters such as shown in U.S. Design Pat. No. D518,126 to Sloboda, D405,491 to Bizovi, D434,094 to Miyashita, D404,450 to Weeks, D325,949 to Harris, Jr., D246,329 to Little and D321,625 to Werner.

Many of the innovations address the concept of putter head to ball alignment when addressing a ball in the performance of a putt and others address issues with respect to a swingweight of a club. However, most innovations do not address both issues in a single club or putter. Also, most alignment concepts for positioning a head of a putter by viewing one or more lines, grooves or slots provided on an upper surface of the head do so without having any means for positively orienting a putting face of the head to insure the putter face is perpendicular to an intended line of a putt. Thus, current alignment concepts do not assure an accurate putt.

In view of the foregoing, there is a need to provide a putter that includes a structure to assure an accurate alignment of a face of the putter head relative to a ball and at the same time address issues with respect to obtaining an optimization with respect to the swingweight of the putter to suit a specific player.

In addition, golf clubs and putters are conventionally manufactured for use by either left handed or right handed players. It would be beneficial and reduce supply costs if golf clubs, such as putters, could be adjusted for use by both left and right handed players.

SUMMARY OF THE INVENTION

The present invention is directed to a "mallet" type putter used in the game of golf wherein the putter head extends rearward from a planar front putting face. The putter head has an upper surface that is generally planar or flat and a cavity is formed in a bottom of the head between opposite sides and a front portion thereof. The cavity extends from the rear of the head toward the front portion approximately two thirds of a length of the head such that when viewed from the rear, the putter head has a lower open area formed between the side portions. The outer surface of each of the opposite side portions of the head have at least one slot therein in which different weights or sets of weights may be selectively mounted so as to adjust a swingweight of the club to suit each player. The weights may be secured through the use of various fasteners including screws that may be secured within one or more threaded openings formed in the side portions of the head. In preferred embodiments of the invention, the weight slots are formed generally centrally in the outer walls of the side portions of the putter head, however, in some embodiments, the slots may be formed more forward or rearward relative to the sides of the head.

The putter head is integrally formed of a metal material and the lower surfaces of the opposite side portions may taper slightly upwardly from a central portion of the head such that the central portion of the front portion of the head is somewhat greater in thickness than the side portions.

A first central elongated alignment groove is provided in the upper surface of the head which extends along a central axis of the head from the rear of the head to the putting face, or adjacent the putting face. The central groove extends perpendicularly to a plane of the putting face such that the central groove is aligned with a center of mass of the putter head when the same amount of weight, or no weight, is provide within the weight slots in each of the opposite side portions of the putter head.

The putter head is connected to a club handle by a hosel that is seated withing the central elongated alignment groove in close proximity to the putter face. The hosel includes a top wall and side walls that are used to prevent putter head tilt when making a putt as will be described in greater detail hereinafter.

The upper surface of the head also includes at least one set, and preferrably two sets, of spaced putting face alignment slots or markers. A first pair of alignment slots or markers are provided on opposite sides of the central groove and extend perpendicular to the plane of the putter face. In the preferred embodiment, each of the first alignment slots are formed as a spaced series of slots that are spaced outwardly between the hosel and the opposite sides of the putter head. The second set of alignment slots are formed in the upper surface of the putter head adjacent and parallel to the putter face on opposite sides of the central channel. The second set of alignment slots extend outwardly toward the opposite sides of the putter head.

In preferred embodiments, the hosel is removably mounted to the head at a point within the central groove adjacent the putting face and intermediate the two sets of alignment slots.

The hosel is secured to the head such as by using a threaded screw fastener that extends through an opening in a front portion of the putter head and which opens out into the central groove. The opening includes a recessed portion in the lower surface of the head in which a head of the fastener is received such that the faster will not extend from the lower surface of the putter head. The hosel includes a threaded opening into which a threaded shank of the threaded fastener is received.

To assure that a golfer properly aligns the putter of the present invention with a ball prior to a putt, at least one projecting member, which may include a lower portion of a shaft of the club handle, is secured to the hosel so that the projecting member extends outwardly from at least one side, and preferrably both sides, of the hosel so as to be parallel to the putting face and the second set of alignment slots and so that the at least one projecting member is spaced above and equally aligned with and above the first set of alignment slots or markers. In the preferred embodiment, two projecting portions are provided that extend from opposite sides of the hosel and both of which are generally parallel to the upper surface of the head and the plane of the putting face and directly above the first set of alignment slots or markers. In the preferred embodiment, the lower portion of the handle shaft extends through the hosel such that a free end thereof forms a first alignment projection while an inner part of the lower portion of the shaft extends outwardly from an opposite side of the hosel forming a second alignment projection.

To properly align the head of the putter with a ball, the player will be positioned such that his or her eyes are directly over and in vertical alignment with a top of the hosel and with the club head aligned so that the outer free end alignment projection and the inner alignment projection are aligned over the first set of alignment slots and parallel to the second set of alignment slots. Also, the central groove must be aligned with the ball. To insure there is no improper tilt to the putter head, a player also manipulates the club to insure that the top edges of the hosel do not extend outwardly of the central alignment groove and so that the vertical side walls of the hosel are not visible.

To further insure that the putter head is laying flat with no tilt angle between the back or heel and the front or toe of the head, with the present invention, two bands, preferably in color, are provided on either side of the hosel on the lower shank extension. The bands are equally spaced outwardly relative to the hosel so as to define ends which terminate in vertical alignment with one of the inner or outer edges of one of the alignment slots 42A/42B formed in the top wall of the putter head. In the preferred embodiment, the bands are aligned with the inner walls of the slots 42A/42B. When the slots are viewed from above as a player aligns the putter to make a putt, the outer ends of the bands should be aligned with the inner edges of the slots 42A/42B thus assuring that there is not tilt between the heel and toe of the putter head. The bands also visually enhance the player's sense of the role of the shaft extension has in locating the proper position of the putter face perpendicularly to the line of the putt.

As previously noted, the putter of the invention may be used by either left or right handed players. As the head of the putter is uniformly structure relative to the central slot, by simply loosening the threaded fastener for the hosel, the head may be rotated through 180° and thereafter the hosel and shaft re-secured.

It is an object of the present invention to provide a golf putter wherein the head is adjustably mounted to the hosel and handle shaft of the club so that the putter may be used by both left and right handed players.

It is another object of the invention to provide a putter wherein lower projections, which may be formed integral with a lower end of the club shaft, or in the alternative separate projecting members, are used to align between first and second sets of putting face alignment slots formed in the club head, and wherein the putter hosel is aligned relative to a central groove in the head in order to assure proper positioning of the club head during a putt.

It is yet another object of the present invention to provide a putter wherein weights may be added to opposite sides of the putter head in order to individualize the swingweight and feel of the putter to a player.

It is also an object of the present invention to enhance the visual determination of a proper alignment of the face of the putter head perpendicularly to a line of an intended putt and to insure there is to head tilt between the heel and toe of the putter by provide colored bands to the shaft extension on opposite sides of the putter hosel.

BRIEF DESCRIPTION OF THE DRAWINGS

A better understanding of the invention will be had with reference to the accompanying drawings wherein.

DESCRIPTION OF THE PREFERRED EMBODIMENT

Figure 1:
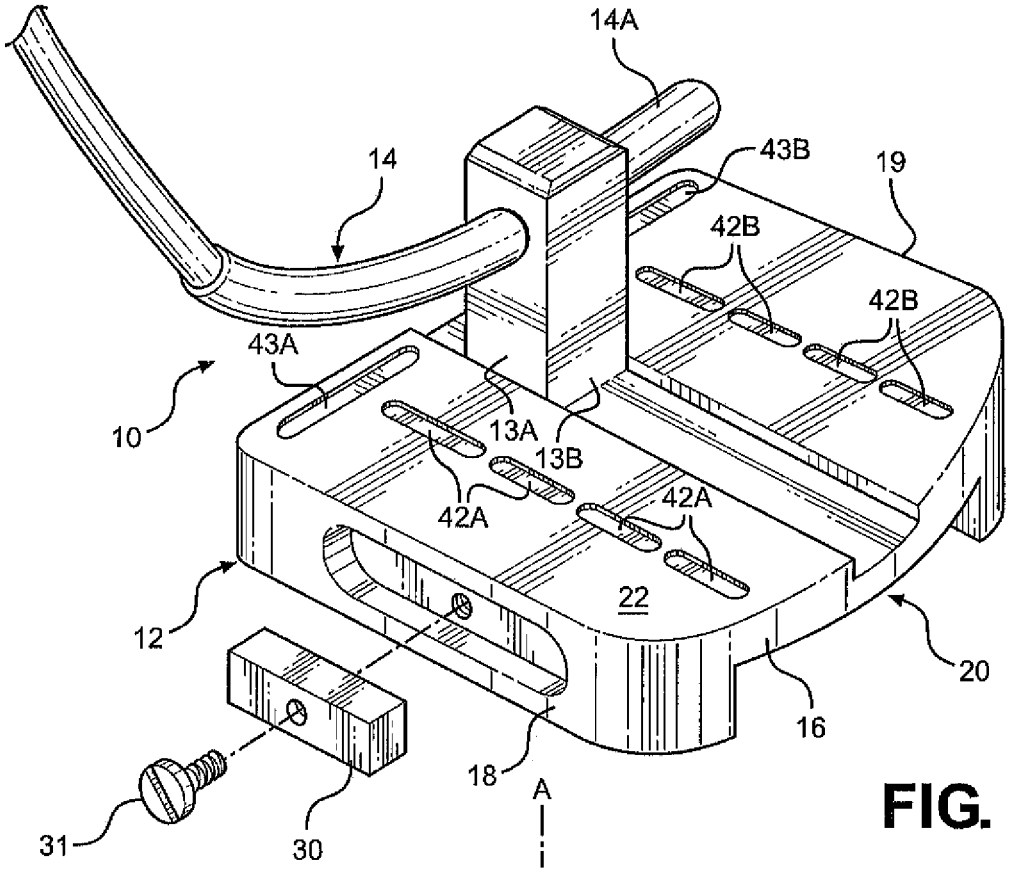
FIG. 1 is a rear perspective view of a putter head, hosel and lower handle shaft of a putter in accordance with the invention.

In golf, players have individualized styles of putting and use different types of putters. Further the manner in which players stand and address a ball during a putt are different. However, there are a number of commonly accepted fundamentals regarding how a head of a putter should be aligned with a ball when making a putt. Each putter has a point on the putting face thereof which is referenced a "sweet spot". The "sweet spot" is aligned with a reference line which extends through a center of mass of the putter head and which is perpendicular to the face of the putter. The "sweet spot" should be aligned with the ball with the face of the putter oriented perpendicularly to the intended line of the putt. To assure proper club alignment, the player's line of sight should be directly over the reference line at the area of the "sweet spot".

With continued reference to the drawings, a putter 10 is shown that is provided with means for assuring that the club head and the "sweet spot" of the club head are properly aligned with a ball before a putt is made. Portions of the putter 10 are shown including the putter head 12, hosel 13 and a lower shank extension 14 which extends upwardly to a club handle, not shown. The club head 12 is shown as being of the "mallet" type in that the head extends from a planar front putting face 15 rearward to an arcuate portion 16. The head is preferrably formed by CNC maching from solid metal or is investment cast with secondary CNC maching of surfaces.

Figure 2:
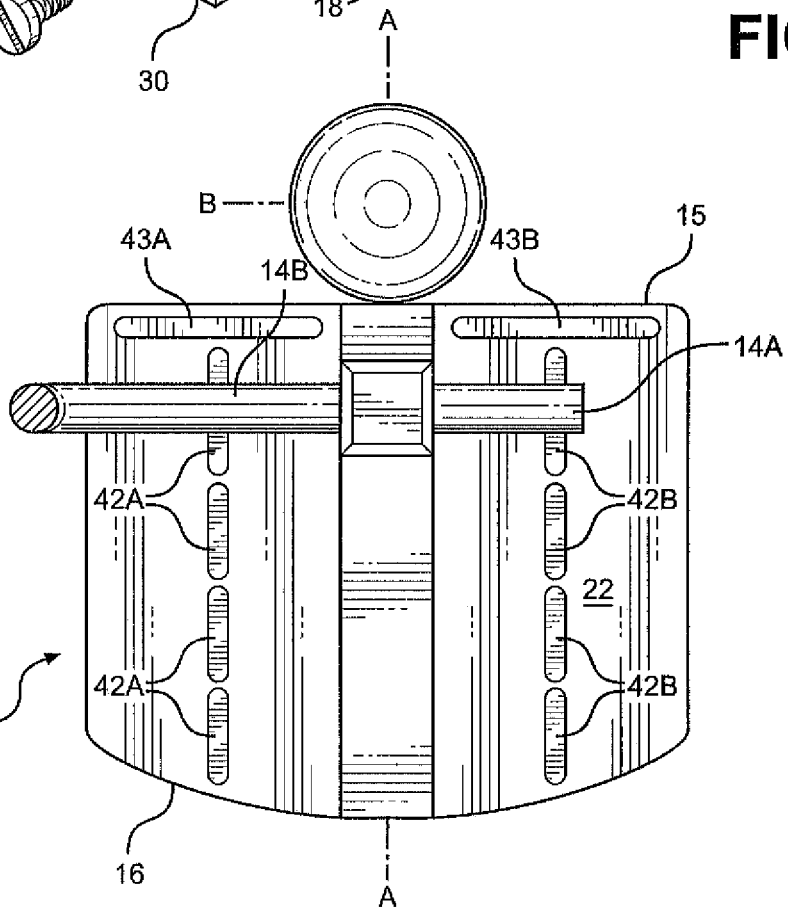
FIG. 2 is a top plan view showing a proper alignment of the club head, hosel and lower handle shaft of the invention during a putt relative to a central groove that extends perpendicular to front face of the putter head and first and second sets of alignment slots that extend perpendicular to the front face and parallel to the front face of the putter and wherein the ball is aligned with the central groove and wherein the lower handle shaft forms two projections that are aligned uniformly over the first set of perpendicular slots and parallel to the second set of parallal alignment slots.

Unlike conventional putters, the hosel 13 is preferrably removably secured to the head so as to be positioned adjacent the front face 15 and centrally of the head and spaced somewhat close to the front face as shown in FIG. 2. Thus the hosel is aligned with a central longitudinal axis A-A of the head. Further, as the head is uniformally constructed on opposite sides of the central axis A-A, the hosel is also aligned with the "sweet spot" located at the center point of the putter face. The manner in which the hosel is attached will be described in greater detail hereinafter. However, it should be noted that the manner in which the hosel is mounted permits the handle to be extended from either of the opposite sides 18 and 19 of the head so that the putter may be easily adapted for use by left and right handed players.

Figure 3:
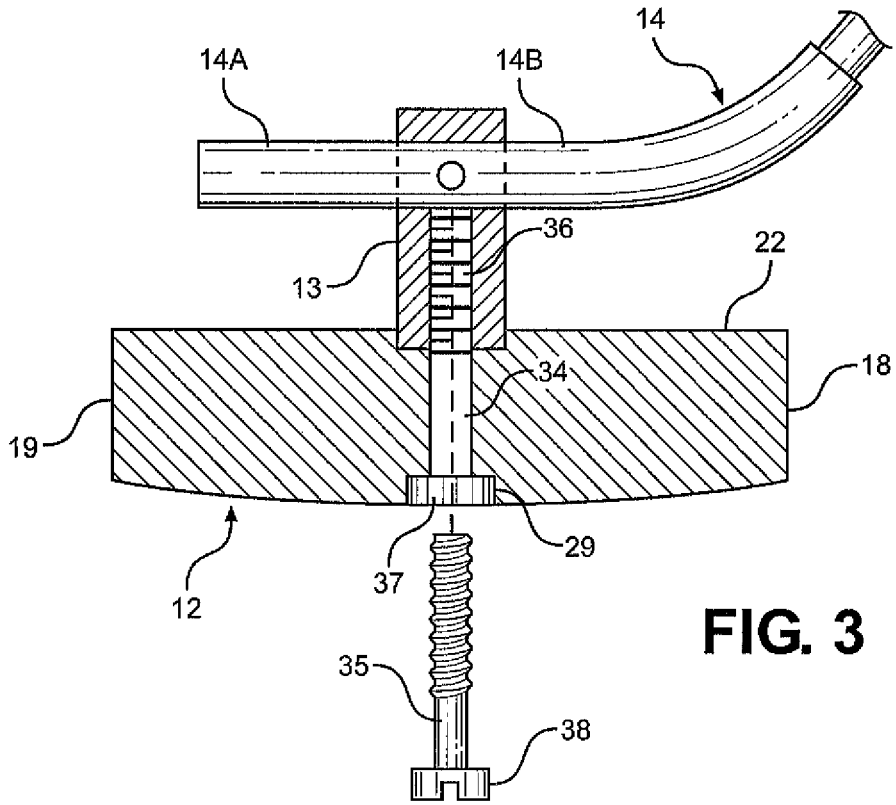
FIG. 3 is a cross sectional view taken through the putter head and hosel illustrating the manner in which the hosel may be adjustably connected to the head so that the putter may be used by either left or right handed players.
Figure 4:
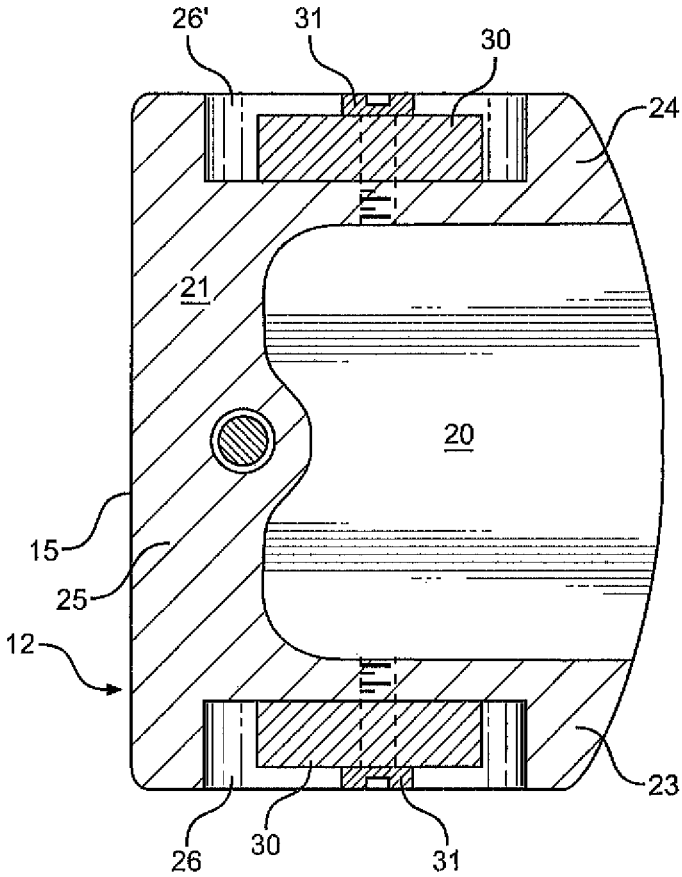
FIG. 4 is a partial bottom cross sectional view showing a cavity in the bottom of the putter head and weights secured in recesses formed in opposite sides of the putter head.

With reference to FIG. 4, in the preferred embodiment of the invention, the bottom of the putter head includes a cavity 20 that extends from a bottom wall 21 toward a top wall 22 of the head so that, along the bottom of the head, two oppositely spaced side portions 23 and 24 and a front portion 25 extend from the top wall to the bottom wall of the head. As shown in FIG. 3, the bottom wall 21 of the head may be tapered slightly upward toward side walls 18 and 19 of the head from a generally flat central portion 29 of the bottom wall. The central portion generally will not exceed one and one-half to two inches in size.

At least one weight receiving slot 26/26' is formed in each of the side walls 18 and 19 of the oppositely spaced side portions 23 and 24, respectively, in which different weights 30, or sets of weights, may be selectively mounted so as to adjust the swingweight of the club to suit a player. The weights may be secured through the use of various fasteners including screws 31 that may be secured within one or more threaded openings 32 formed in the side portions of the head. In preferred embodiments of the invention, the weight slots are formed generally centrally in the outer walls of the side portions of the putter head, however, in some embodiments, the slots may be formed more forward or rearward relative to the sides of the head.

As shown in FIG. 3, the front portion of the head has an opening 34 there through which passes through the longitudinal axis A-A and perpendicularly thereto in which a fastener, such as a screw 35, may pass in order to be threadingly engaged within a threaded opening 36 formed in a central portion of the hosel 13. A countersunk opening 37 is formed about the lower portion of the opening 34 in which a head 38 of the screw is received when the screw is tightly secured within the threaded opening 36. By removing the screw 35 from the hosel, the hosel and thus the lower shaft extension 14 may be rotated 180° afterwhich the hosel may be secured to the head by tightening the screw 35. In this manner the club 10 can be selectively changed to a right or left handed club. To prevent the hosel from becoming loose from the head, the hosel 13 is cooperatively seated within a central alignment groove 40 that extends from the back to the front of the club head. The groove is aligned along the central axis A-A and is used by a player to insure that the club head is accurately aligned with a ball "B" prior to a putt being made. As the groove 40 is aligned with the "sweet spot" of the face of the head of the putter, by aligning the groove with the ball as the ball is struck, the ball will more likely follow a path intended by a player. The groove may, for example be one half to five-eights inch in width.

To further assure that the face of the head of the putter is properly aligned with a ball "B" prior to a putt, at least one and preferrably two sets of spaced alignment slots 42A/42B and 43A/43B are formed in the top wall 22 of the head. The slots 42A/42B are preferably formed as spaced slot segments that are aligned with one another and which extend perpendicular to the plane of the putter face and parallel to and on opposite sides of the central groove 40. The segmented slots 42A/42B are preferably positioned between one inch to one and an eighth inch from the central axis A-A of the putter head. The slots 43A/43B extend outwardly relative to the groove 40 toward the side walls of the putter head so as to be parallel to the putting face 15 of the head. The slots 43A/43A are positioned closely adjacent to the putting face of the head so as to be forward of a plane defined by a front surface of the lower shaft extension 14 when viewed from above the head, as shown in FIG. 2.

It should be noted from FIG. 3 that the lower shaft extension 14 includes an outer free end portion 14A and an inner end portion 14B which are both formed to extend parallel to and above the top wall 22 of the putter head as well and parallel to a plane defined by the putting face 15 of the putter head. These portions of the shaft are each approximately an inch in length in order to allow for good visual alignment when viewing the ball/putter interface from a putting stance wherein a player is looking vertically down toward the top of the hosel, as shown in FIG. 2. When in proper alignment, the end portions 14A and 14B will be observed as being equally spaced over the forward segmented slots 42A/42B and will be parallel to the alignment slots 43A/43B as is illustrated in FIG. 2. When the groove 40 of the club head is also aligned with the ball, the ball, when struck, will follow the intending putting direction as the angle of the putting face will be truly perpendicular to the direction of impact of the putting face 15 on the ball.

When a player properly addresses the ball, when looking down over the top of the hosel as shown in FIG. 2, if the club is properly aligned none of the vertical side walls, such as shown at 13A and 13B, will be visible and the opposite side walls 13A will not extend beyond the side walls defining the central groove 40. When the aforementioned conditions are met, there will be no putter head tilt in any direction. Due to the use of the hosel for control of club head tilt, it is preferred that the hosel is somewhat square or rectangular in cross section with the spacing, at least between opposite side walls 13A being equal to the width of the central alignment slot 40. Also, at least the sidewalls 13A should not extend outwardly relative to the edges defining the top of the hosel. In the preferred embodiment, the hosel may have a height up to approximately one and three-eights to one and a half inch.

In an alternate embodiment of the invention, as opposed to extending the lower shaft extension 14 through the hosel, the extension may include only the inner portion 14B and a separate alignment pin or projection, constructed similar to the outer free end extension portion 14A, would be mounted to the hosel and aligned parallel to both the upper surface and putting face of the putter head.

It should be noted that the slots may be formed as marked lines or the like although the slots are preferred as slots will not be subject to wear and tear as applied markings may be and because the slots will more dramatically focus the players eyes to assure proper club head and ball alignment.

Figure 5:
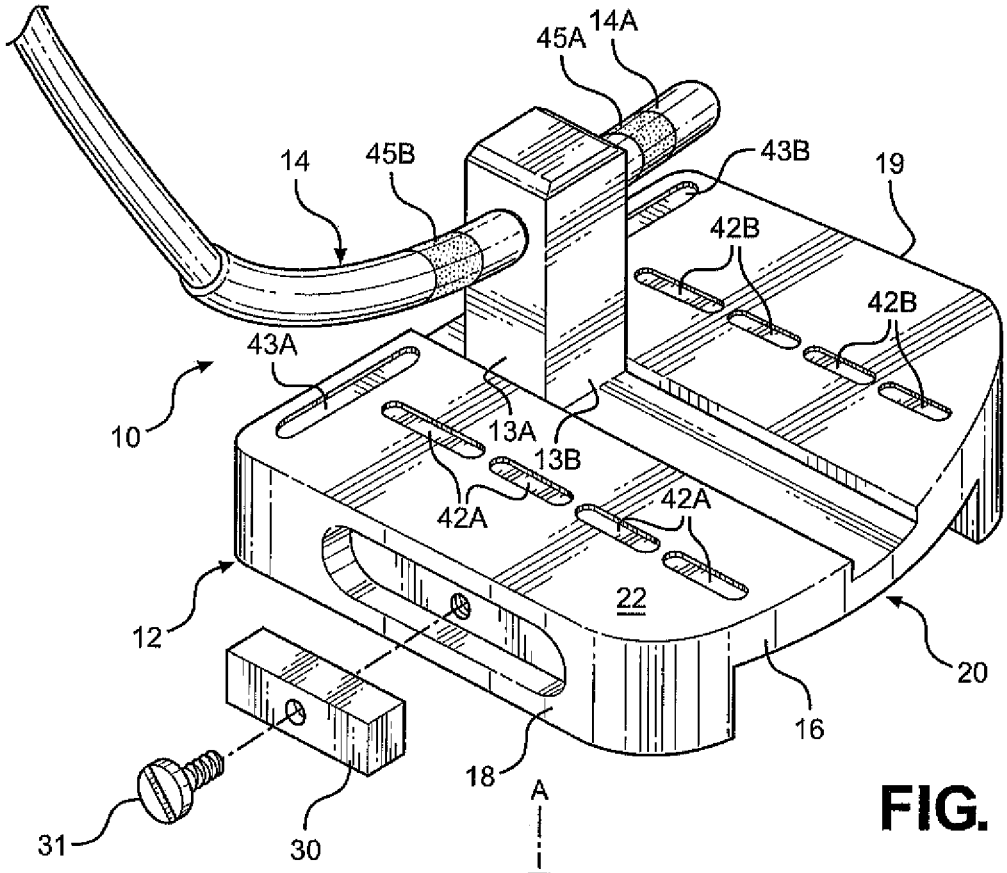
FIG. 5 is a view similar to FIG. 1 showing alignment bands applied to a shaft extension on opposite sides of the putter hosel for alignment with the second set of alignment slots.
Figure 6:
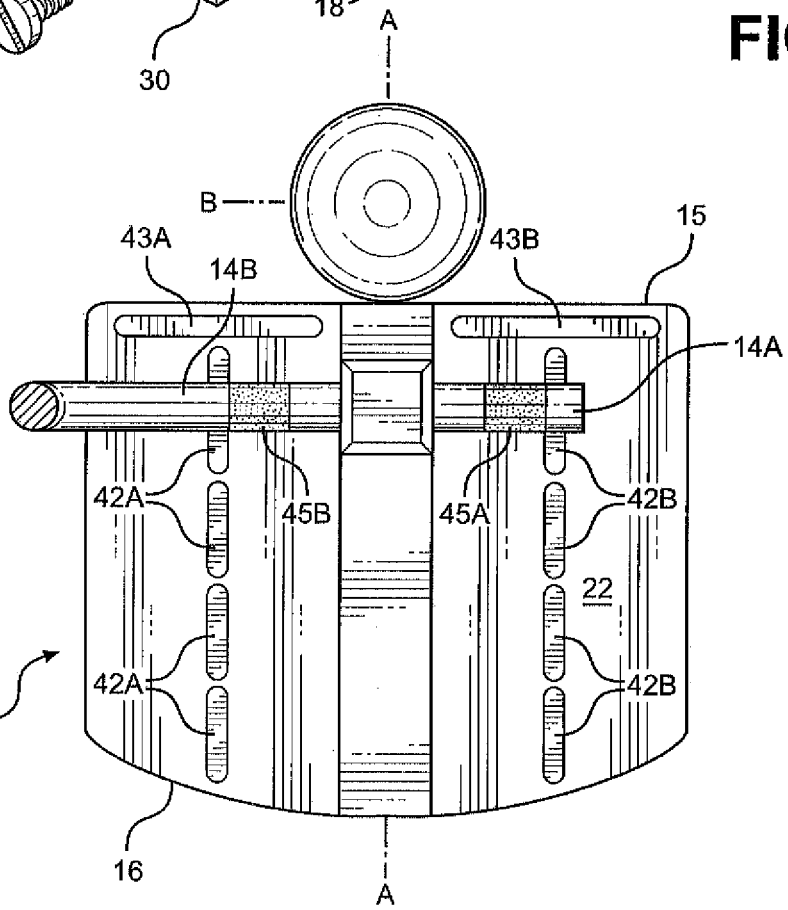
FIG. 6 is a view similar to FIG. 2 showing the alignment bands of FIG. 5 aligned with inner edges of the second alignment slots.

With specific reference to FIGS. 5 and 6, to further insure that the putter head is laying flat with no tilt angle between the back or heel and the front or toe of the head, two alignment bands 45A and 45B, preferably in color, are provided on either side of the hosel 13 on the lower shank free end portion 14A and inner end portion 14B, respectively. The alignment bands may be up to approximately ¾ inch in length. The alignment bands are equally spaced outwardly relative to the hosel so as to define ends which terminate in vertical alignment with one of the inner or outer edges of one of the alignment slots 42A/42B formed in the top wall 22 of the putter head. In the preferred embodiment, the bands are aligned with the inner walls of the slots 42A/42B which are closest to the face of the putter. When the bands are viewed from above as a player aligns the putter to make a putt, the outer ends of the bands should be aligned with the inner edges of the slots 42A/42B, as shown in FIG. 6, thus assuring that there is not tilt between the heel and toe of the putter head. The bands also visually enhance the player's sense of the role of the shaft extension has in locating the proper position of the putter face perpendicularly to the line of the putt. In some embodiments of the invention, only one band is provided to be aligned with one of the second segmented slots 42A or 42B.

As previously described, the putter of the present invention is provided with a set of weights that may be selectively secured within the weight slots 26/26' of the putter head to thereby adjust the swingweight of the putter. In the industry, swingweights are defined by combinations of a letter and a number with the lightest being an AO weight and the heaviest being a G10 weight. Thus, letters A, B, C, D, E, F and G are used in combination with numbers 0, 1, 2, 3, 4, 5, 6, 7, 8, and 9 (with G going up to 10). Manufactures generally use a standard swingweight of D0 or D1 for mens clubs and C5 to C7 for womens clubs. With the present invention, a set of at least three swingweight pairs such as C, D and E series weights may be provided with the putter.

In the use of the putter 10, a player addresses a ball and views the ball/putting face interface as shown in FIG. 2 of the drawings by looking directly down at the top of the hosel to ensure the head is aligned such that the vertical side walls of the hosel are not visible and the upper edges of the top wall do not extend outwardly beyond the central alignment groove. The central alignment groove is aligned with the center of the ball and the club head is moved until the first and second sets of alignment slots are proper aligned as previously described and such that the player visually notes the proper positioning of the alignment pins or shaft extensions 14A/14B relative to the slots. The player also insures that the colored bands 45A and 45 B are aligned with the inner edges of the underlaying second alignment slots 42A and 42B. The player and the putter are now properly positioned to make a putt.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A putter for use in a game of golf, the putter comprising a handle from which exends a shaft having a lower extension portion, the extension portion being mounted to a hosel so as to extend generally parallel to a plane defined by an upper surface of a club head of the putter, means for mounting the hosel to the club head, the club head having a front putting face, rear portion, opposite side portions and upper and lower surfaces, the club head having a central longitudinal axis that extends perpendicularly with respect to the putting face, a central alignment marker provided along the upper surface so as to be perpendicular to the putting face and in alignment with the central longitudinal axis for aligning a central sweet spot of the putting face with a ball, a set of spaced alignment markers provided along the upper surface of the putter head and on opposite sides of and parallel to the central alignment marker, the hosel being mounted adjacent to but spaced from the putting face to the upper surface of the club head and in alignment with the central alignment marker, at least one alignment projection extending outward from the hosel so as to be spaced above the central alignment marker and perpendicular to the set of spaced alignment markers, at least one alignment band being provided on one of the lower extension of the shaft or the at least one alignment projection, the at least one alignment band having a end that is vertically aligned relative to one of the set of spaced alignment markers, and whereby a proper alignment of the putting face with a ball is visually determined by aligning the at least one alignment projection with one of the set of spaced alignment markers and aligning the at least one alignment band with one of the set of spaced alignment markers when the club head is viewed from above.

2. The putter of claim 1 including at least one pair of spaced additional alignment markers, the additional alignment markers being parallel to the putting face and between the putting face and the hosel.

3. The putter of claim 2 wherein the additional alignment markers and the set of alignment markers are formed as slots in the upper surface of the putter head.

4. The putter of claim 3 wherein the central alignment marker is formed as a groove within the upper surface of the putter head, and the hosel being mounted within the groove.

5. The putter of claim 4 including two alignment bands, one alignment band provided on the lower extension of the shaft and one alignment band provided on the at least one alignment projection.

6. The putter of claim 5 wherein the alignment bands are equally spaced outwardly on opposite sides of the hosel.

7. The putter of claim 1 wherein the at least one alignment extension is formed by a free end of the lower shaft extension which is connected to the hosel.

8. The putter of claim 1 wherein weight receiving slots are provided in each of the opposite side portions of the putter head, and a set of weights for being selectively mounted within the weight receiving slots.

9. The putter of claim 1 wherein the lower surface of the putter head tapers upward toward side walls of the opposite side portions of the putter head.

10. The putter of claim 1 wherein a center of mass of the putter head is located along the central longitudinal axis.

11. The putter of claim 1 including means for adjustably mounting the hosel to the putter head so that the putter may be used for right and left handed putting.

12. The putter of claim 1 wherein the central alignment member is formed as a groove within the upper surface of the putter head, and the hosel being mounted within the groove.

13. The putter of claim 1 wherein the hosel includes a top surface and vertically extending side walls which do not extend outwardly relative to the top surface when viewed from directly above the top surface and wherein at least two oppositely oriented side walls are spaced from one another at a distance which is equal to a width of the groove.

14. The putter of claim 1 including two alignment bands, one alignment band provided on the lower extension of the shaft and one alignment band provided on the at least one alignment projection.

15. The putter of claim 14 wherein the alignment bands are equally spaced outwardly on opposite sides of the hosel.

16. A putter for use in a game of golf, the putter comprising a handle from which exends a shaft connected to a hosel, a pair of alignment projections extending from opposite sides of the hosel, means for mounting the hosel to a club head having a front putting face, rear portion, opposite side portions and upper and lower surfaces, the club head having a central longitudinal axis that extends perpendicularly with respect to the putting face, a first alignment groove provided along the upper surface so as to be perpendicular to the putting face and in alignment with the central longitudinal axis for aligning a central sweet spot of the putting face with a ball, the hosel being mounted within the groove adjacent to but spaced from the putting face, a first pair of spaced alignment slots provided along the upper surface and on opposite sides of the groove, the first pair of alignment slots being parallel to the groove and perpendicular to the putting face, a second pair of alignment slots extending from opposite sides of the hosel toward the opposite side portions, the second alignment slots being parallel to the putting face, the pair of alignment projections extending outward from the hosel so as to be spaced above the first pair of alignment slots and rearward relative to the second alignment slots, at least one alignment band being provided on one of the lower extension of the shaft or the at least one alignment projection, the at least one alignment band having a end that is vertically aligned relative to one of the second pair of alignment slots, whereby a proper alignment of the putting face with a ball is visually determined by aligning pair of alignment extensions with the first and second pairs of alignment slots and aligning the at least one alignment band with one of the second pair of alignment slots when the hosel of the club head is viewed from above.

17. The putter of claim 16 including two alignment bands, one alignment band provided on each of the alignment extensions.

18. The putter of claim 17 wherein the alignment bands are equally spaced outwardly on opposite sides of the hosel.

* * * * *